US006074306A

United States Patent [19]

Behringer

[11] Patent Number: 6,074,306

[45] Date of Patent: Jun. 13, 2000

[54] AMUSEMENT PARK VEHICLE FOR THE PHYSICALLY DISABLED

[75] Inventor: Georg Behringer, Waldkirch, Germany

[73] Assignee: Universal Studios, Inc., Universal City Plaza, Calif.

[21] Appl. No.: 09/163,375

[22] Filed: Sep. 28, 1998

[30] Foreign Application Priority Data

Jan. 20, 1998 [DE] Germany ..... 198 01 912

[51] Int. Cl.[7] ..... A63G 31/02

[52] U.S. Cl. ..... 472/43; 472/45; 414/921

[58] Field of Search ..... 472/43, 45, 2, 472/131; 297/344.12, 344.15, 344.17; 414/921, 543; 104/53, 59

[56] References Cited

U.S. PATENT DOCUMENTS

| | | | |
|---|---|---|---|
| 3,830,161 | 8/1974 | Bacon . | |
| 4,077,483 | 3/1978 | Randolph | 180/6.5 |
| 4,143,436 | 3/1979 | Jones . | |
| 4,170,368 | 10/1979 | Southward et al. . | |
| 4,221,008 | 9/1980 | Nolan . | |
| 4,306,634 | 12/1981 | Sangster . | |
| 4,352,218 | 10/1982 | Lundberg . | |
| 4,399,570 | 8/1983 | Tracy et al. . | |
| 4,545,616 | 10/1985 | Booth | 297/320 |
| 4,581,778 | 4/1986 | Pontoppidan . | |
| 4,662,298 | 5/1987 | Strahle . | |
| 4,733,418 | 3/1988 | Luther . | |
| 4,846,529 | 7/1989 | Tulley . | |
| 4,862,997 | 9/1989 | Eberle | 297/345 X |
| 4,901,968 | 2/1990 | Ellis et al. . | |
| 4,928,330 | 5/1990 | Moore . | |
| 5,209,178 | 5/1993 | Rowe . | |
| 5,213,547 | 5/1993 | Lochtefeld . | |
| 5,279,004 | 1/1994 | Walker . | |
| 5,316,480 | 5/1994 | Ellsworth . | |
| 5,365,618 | 11/1994 | Gilbert . | |
| 5,421,782 | 6/1995 | Lochtefeld . | |
| 5,431,526 | 7/1995 | Peterson et al. . | |
| 5,456,335 | 10/1995 | Kinsey . | |
| 5,503,597 | 4/1996 | Lochtefeld et al. . | |
| 5,549,072 | 8/1996 | Maloney . | |
| 5,564,984 | 10/1996 | Mirabella et al. . | |
| 5,577,278 | 11/1996 | Barker et al. . | |
| 5,613,825 | 3/1997 | Dorn . | |
| 5,667,445 | 9/1997 | Lochtefeld . | |
| 5,709,154 | 1/1998 | Schott . | |
| 5,715,756 | 2/1998 | Weigand et al. . | |
| 5,884,563 | 3/1999 | Sheldon et al. | 104/53 |

OTHER PUBLICATIONS

PCT International Search Report (International Appln. No. PCT/US97/10062).

*Primary Examiner*—Kien T. Nguyen
*Attorney, Agent, or Firm*—Lyon & Lyon LLP

[57] ABSTRACT

An amusement ride vehicle has a seat on a seat chassis. The seat moves up for assisting a physically disabled person to enter or exit the vehicle. The seat moves down before the vehicle begins to ride. A slide is attachable to the vehicle to help a disabled person get into and out of the elevated seat. The seat chassis can pivot forward to provide access to the motor which lifts and lowers the seat.

15 Claims, 5 Drawing Sheets

AMUSEMENT PARK VEHICLE FOR THE PHYSICALLY DISABLED

FIELD OF THE INVENTION

The present invention relates to amusement park rides and vehicles.

BACKGROUND

Vehicles with passenger seats are used in roller coasters, water rides, and other amusement park rides. Unfortunately, these types of rides have long presented difficult or impossible obstacles to physically disabled persons. Generally, these rides have required riders to climb into and out of a confined vehicle space, a movement requiring some agility even by non-disabled persons. Hence, while the physically disabled are able to travel to an amusement park, and to travel around within the amusement park once they arrive there, they are nonetheless still not able to fully enjoy the amusement park rides, due to the barriers these types of rides present them.

With the now long overdue better integration of physically disabled people into daily life, including leisure time, there is a rising need to make these kinds of rides available and accessible to the physically disabled.

SUMMARY OF THE INVENTION

In a first aspect of the present invention, a ride vehicle has at least one seat which has a lifting chair vertically movable between up and down positions. When elevated, the lifting chair enables a physically disabled person to sit down on the lifting chair, with little or no help of others.

In a second aspect of the invention, the lifting chair is moved by a drive motor which can be an electric motor, or a hydraulic or pneumatic system. With an electric motor, a battery provides the power source, independent from outside energy supplies.

In a third aspect of the invention, the lifting chair is supported by a counterbalancing spring. The spring reduces the lifting force which the drive must exert.

In a fourth aspect of the invention, the chair is equipped with guiding wheels which roll in guide rails, to guide chair movement.

Accordingly, it is an object of the invention to provide a ride vehicle accessible by physically disabled persons.

Other features and advantages of the present invention will become apparent from the following description of the preferred embodiment and the referenced drawings.

DETAILED DESCRIPTION OF THE PREFERRED EMBODIMENT

Figure 1:
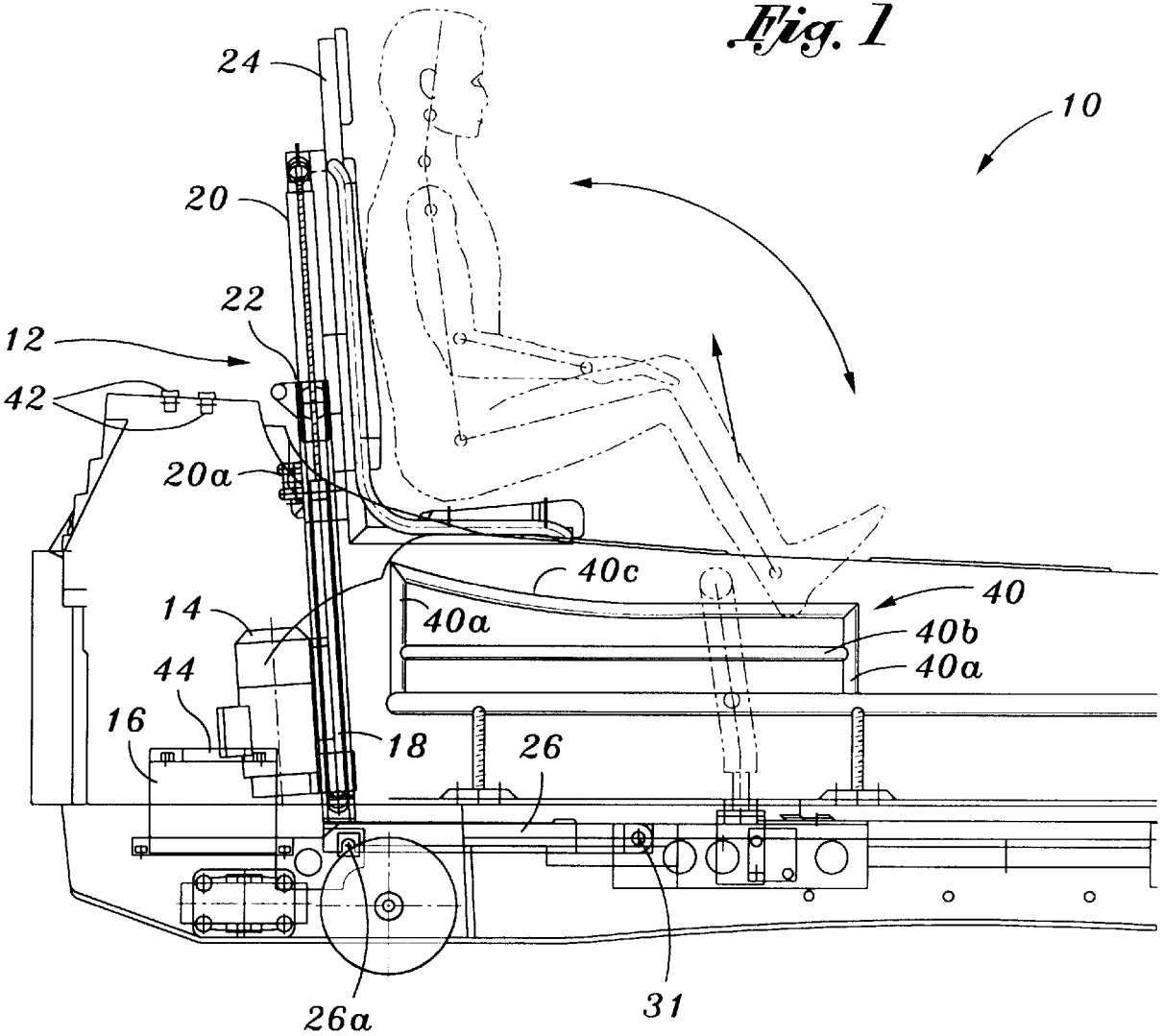
FIG. 1 is a side view of the rear end of the present vehicle and lifting chair.

FIG. 1 is a side view of the rear end of a vehicle 10 with a lifting chair 12, here shown in the up position with a passenger in the seat.

The lifting movement of chair 12 is provided by an electric motor 14 which is mounted to the rear end of vehicle 10. Electric motor 14 is powered by a battery 16 which is placed behind electric motor 14 in the rear of vehicle 10.

Figure 5:
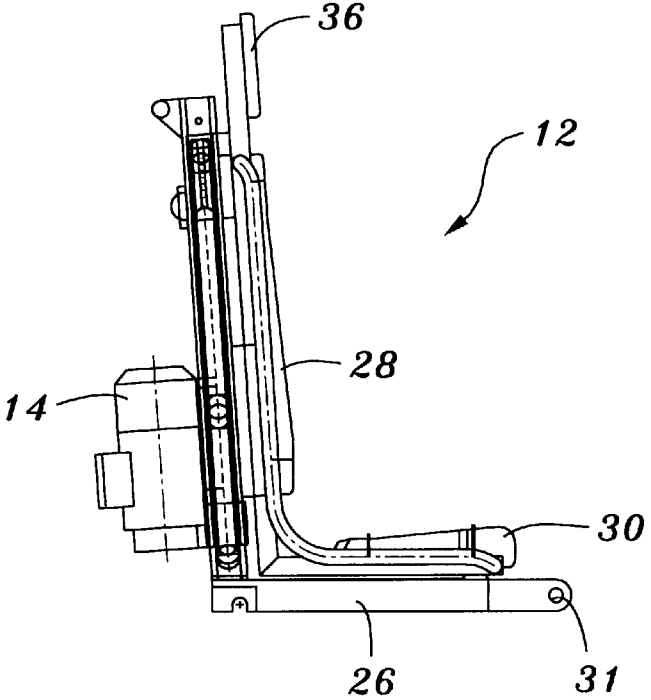
FIG. 5 is a side view of the lifting chair in the down position.

The chair 12 has a frame 24 in an L-shape, with guiding wheels 22 on the chair frame 24 rolling within C-channel guiding tracks 20 spaced apart at the back of the chair frame 24. The lower ends of guiding tracks 20 are attached to the back end of an underchassis 26, as shown in FIG. 5. The front end of underchassis 26 is attached to the vehicle 10 at a pivot joint 31. The rear end of the underchassis 26 is attached to the vehicle 10 by a latch 26*a*, and a pin or bolt.

Figure 7:
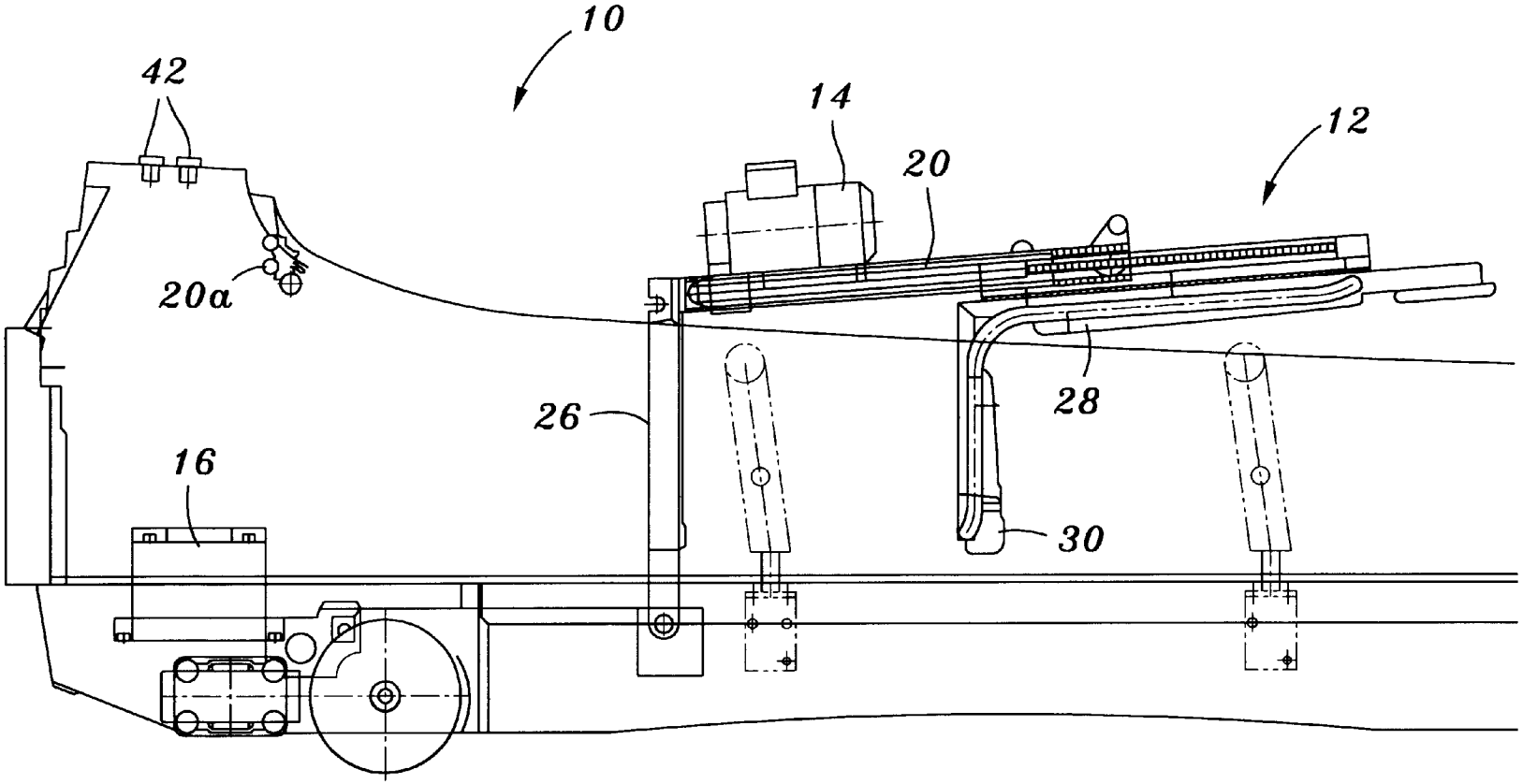
FIG. 7 is a side view of the rear end of the vehicle with the lifting chair folded forward.

Accordingly, after disconnecting the latch 26*a*, it is possible to fold or pivot the whole lifting chair 12 forward, into the position shown in FIG. 7. The lifting chair 12 folds or pivots around pivot joint 31 to gain an easier access to the battery 16 for maintenance purposes. In ordinary use, the lifting chair 12 is secured in the unfolded position via both the latch 26*a* and the bolt or fastener. A secondary latch 20*a*, between the tracks 20 secures the chair in its upright position as well.

The electric motor 14 is placed in the rear of vehicle 10 and mounted to lifting chair 12. The lifting movement is applied to chair frame 24 by a spindle or lead screw 14*a* (see FIG. 2) which is driven by the electric motor 14. The lead screw extends through a fixed collet on the chair frame 24.

Handles 40 extend along the entire gripping, area, and preferably include two vertical struts 40*a* and two horizontal struts 40*b* and 40*c*, which are attached to the vertical struts 40*a*. The rear end of the upper horizontal strut is placed higher than the front end so that it slopes downwardly towards the front.

As shown in FIG. 1, lifting chair controls 42 are located at the rear end of vehicle 10, to control the movement of the lifting chair 12.

The battery 16 is equipped with a quick release connector 44 for recharging the battery. It is also possible to employ an electric connection from the quick release connector 44 to the electric motor 14 when the lifting chair is in the drive position.

Figure 2:
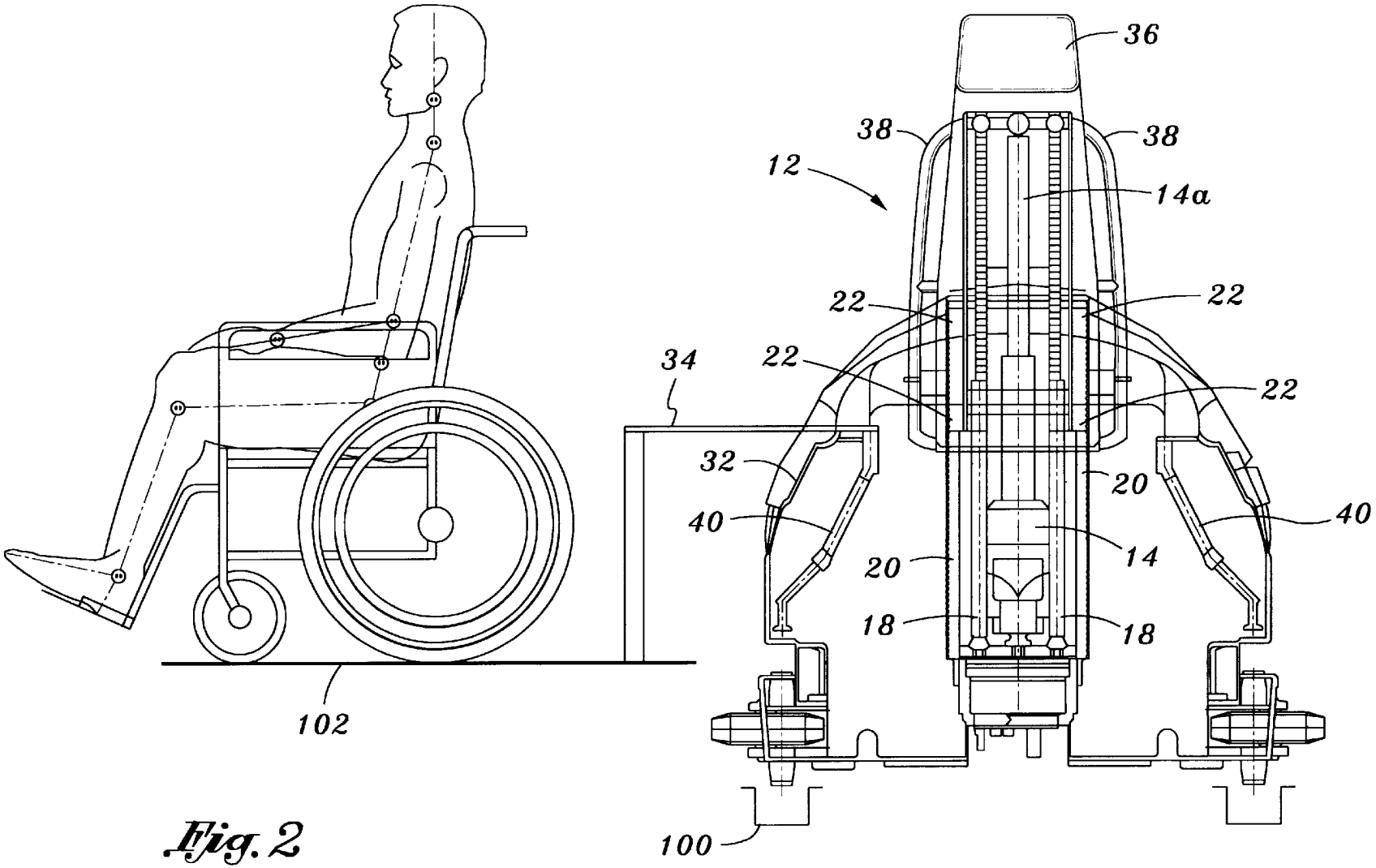
FIG. 2 is a rear view thereof.

As shown in FIG. 2, a physically disabled rider can get onto the seat of the lifting chair 12 by a slide 34 temporarily attached to the sidewalls 32 of vehicle 10. The seat padding 30 of the lifting chair 12 is at approximately the same height as that of the slide 34. A headrest 36 is placed at the upper end of the chair frame 24 and is preferably attached to the vertical strut of the chair frame 24.

A spring 18 is placed parallel to guiding tracks 20. The spring 18 counterbalances the weight of electric motor 14 and the chair 12. The maximum possible elevation in the preferred embodiment is up to 550 mm (19.5 inch). The guiding tracks 20 and pressurized spring 18 are not only parallel to each other, but also symmetric to the vertical middle axis of lifting chair 12.

Figure 4:
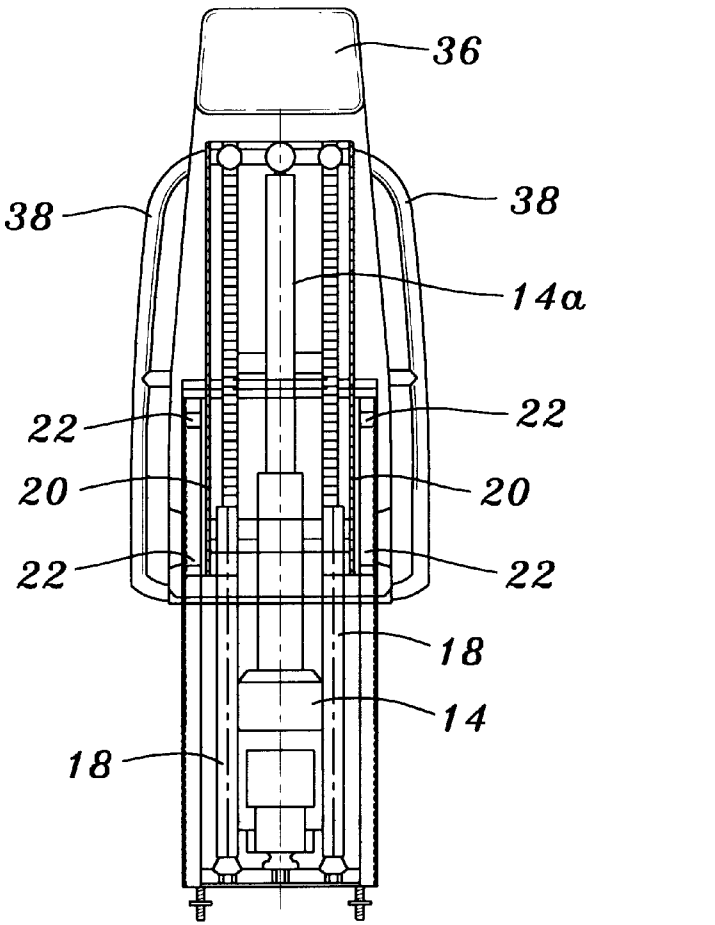
FIG. 4 is a rear view of the lifting chair in the up position.
Figure 3:
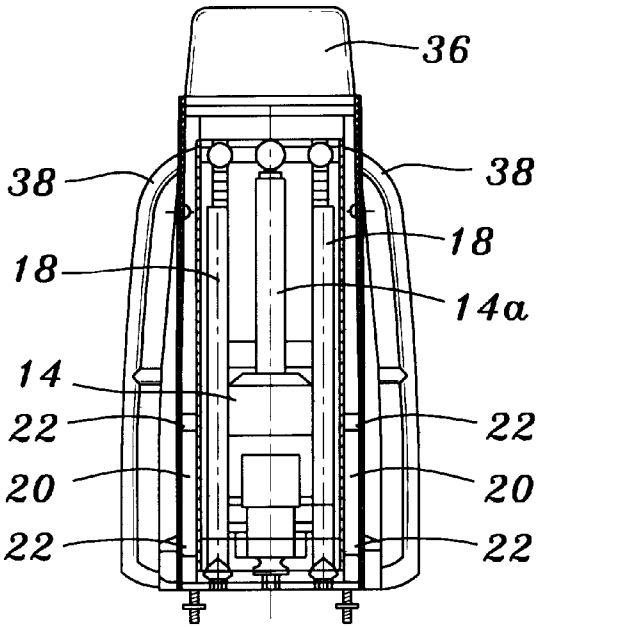
FIG. 3 is a rear view of the lifting chair in the down position.

FIGS. 3–5, in particular, show the guiding tracks 20, pressurized spring 18, spindle 14*a*, and the electric motor 14, as configured, require little space, making for a very compact construction. Hence, an enlargement of already existing vehicles is not necessary to retrofit the lifting chair into a vehicle 10. The lifting chair 12, without the electric motor 14, is only slightly bigger than a standard seat, and electric motor 14 which is attached to the lifting chair 12, fits into the unusable back area of vehicle 10, if the lifting chair is the last seat in the vehicle 10.

FIG. 7 shows the space which can be used by the maintenance crew for servicing the battery 16 in the rear of vehicle 10, if the lifting chair 12 is folded forward.

Figure 6:
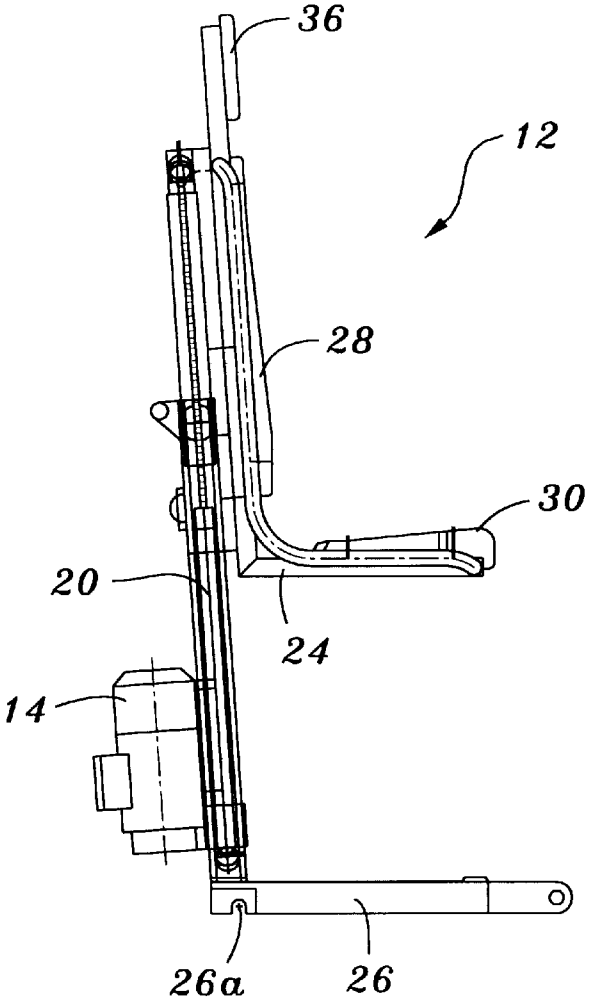
FIG. 6 is a side view of the lifting chair in the up position.

The back padding 28 and the seat padding 30 should be a non-slippery surface. To further support the passenger, seat padding 30 is designed so that it is thicker at the front end. Accordingly, the seated passenger is leaning back, to better resist any unwanted forward movement. This leaning back seating position is also provided via the guiding tracks 20 and the vertical elements of the chair frame 24 extending at a slight rearward angle, as shown in FIGS. 1, 5, and 6.

In use, the vehicle 10 is braked or stopped at a load/unload platform 102. The ride operator presses the up control switch 42. This switches on the motor 14, powered by the battery 16. The motor 14 turns the ball or lead screw 14*a*, optionally through a gear reduction. The ball screw turning within the collet attached to the chair frame 24 lifts the chair 12. The guide wheels 22 roll up in the guiding tracks 20, and prevent lateral or longitudinal movement of the chair, while allowing vertical or near vertical movement. With the chair in the up position shown in FIGS. 1, 2, 4, and 6, the rider moves onto the chair, using the handles 40, and optionally the slide 34. As shown in FIG. 1, when up, the seat base pad 30 is just above the sidewalls 32 of the vehicle. Accordingly, the rider need not climb down into the vehicle. In addition, when the chair is up, the rider's legs are not closely confined, allowing the rider to easily move into a seated position on the chair. As shown in FIG. 2, the slide and seat base pad 30 are at or close to the level of a standard adult wheelchair seat. Hence, the need for the rider to move up or down, in moving from the wheelchair to the lifting chair, is minimized.

Once seated in the lifting chair, the rider then fastens the seat belts. The ride operator unlatches and removes the slide 34 (if it is used). The ride operator presses the down control 42. The motor 14 turns in the opposite direction and the chair and rider are lowered into the vehicle. The vehicle then moves through the ride attraction on a closed loop vehicle path, such as a roller coaster path 100 illustrated in FIG. 2, providing the disabled rider with the same ride experience as non-disabled riders.

After the vehicle returns to the load/unload area, the ride operator presses the up control 42, to raise the chair. The spring 18 exerts a constant up force on the chair, to counterbalance the weight of the chair and motor, and may provide even additional lifting force. Consequently, the lifting force which must be generated by the motor is reduced. Battery life is therefore extended and the motor size and weight reduced. Once back in the up position, the rider exits the vehicle, optionally using the slide 34.

Many modifications will be apparent to designers skilled in the art. The preferred embodiment has been described to explain the principles of the invention. Thus, the invention should not be limited except by the following claims and their equivalents.

What is claimed is:

1. An amusement ride vehicle, comprising:

a vehicle body;

a seat lifter in the vehicle body;

a seat supported on the seat lifter;

biasing means extending between the vehicle body and the seat, for urging the seat upwardly; and a slide attachable to the vehicle body.

2. The amusement ride vehicle of claim 1 wherein the seat lifter includes spaced apart guiderails, and rollers on the seat engaged to the guiderails, and an actuator attached to the vehicle body and to the seat.

3. The amusement ride vehicle of claim 2 wherein the guiderails extend vertically upwardly and rearwardly.

4. The amusement ride vehicle of claim 1 further comprising a seat underchassis supporting the seat, with the underchassis having a front end pivotably attached to the vehicle body, and a rear end attached to the vehicle body with a latch.

5. The amusement ride vehicle of claim 1 further comprising vehicle sidewalls extending upwardly from the vehicle body.

6. The amusement ride vehicle of claim 5 wherein the seat has a seat bottom and a seat back and the lifter is movable between an up position wherein the seat bottom is above the vehicle sidewalls, and a down position wherein the seat bottom is below the vehicle sidewalls.

7. An amusement ride vehicle, comprising:

a vehicle body;

a seat chassis having a front end and a back end, with the front end of the seat chassis pivotably attached to the vehicle body;

a latch on the vehicle body for attaching to the back end of the seat chassis;

spaced apart guiderails on the seat chassis;

a seat movable along the guiderails;

a motor on the seat chassis; and a seat lifter on the seat chassis attached to the seat and connected to the motor.

8. The vehicle of claim 7 wherein the motor is positioned between the guiderails.

9. The vehicle of claim 7 wherein the motor is a battery powered electric motor and the seat lifter comprises a lead screw.

10. An amusement ride comprising:

a closed loop vehicle path extending through an amusement attraction;

a vehicle movable through the amusement attraction only on the vehicle path;

a pair of spaced apart guiderails in the vehicle;

a seat movable only substantially vertically along the guiderails; and lifting means for lifting the seat to allow a guest to move from a wheelchair onto the seat and for lowering the seat back into the vehicle once the guest has moved from the wheelchair onto the seat.

11. The amusement ride of claim 10 wherein the means for lifting comprises a motor attached to, and movable with, the seat.

12. The amusement ride of claim 11 wherein the motor is an electric motor and further comprising a battery in the vehicle linked to the motor.

13. An amusement ride vehicle, comprising:

a vehicle body;

a seat lifter in the vehicle body; and a seat supported on the seat lifter, wherein the seat lifter includes spaced apart guiderails, and rollers on the seat engaged to the guiderails, and an actuator attached to the vehicle body and to the seat.

14. An amusement ride vehicle, comprising:

a vehicle body;

a seat lifter in the vehicle body;

a seat supported on the seat lifter; and biasing means extending between the vehicle body and the seat, for urging the seat upwardly.

15. An amusement ride comprising:

a closed loop vehicle path extending through an amusement attraction;

a vehicle movable through the amusement attraction only on the vehicle path;

a pair of spaced apart guiderails in the vehicle;

a seat movable along the guiderails; and lifting means for lifting and lowering the seat, wherein the means for lifting comprises a motor attached to, and movable with, the seat.

* * * * *